US006157703A

United States Patent [19]

Solomon et al.

[11] Patent Number: 6,157,703

[45] Date of Patent: Dec. 5, 2000

[54] BEAM HARDENING FILTER FOR X-RAY SOURCE

[75] Inventors: Edward G. Solomon, Menlo Park; Giovanni Pastrone, Los Gatos, both of Calif.

[73] Assignee: Cardiac Mariners, Inc., Los Gatos, Calif.

[21] Appl. No.: 09/167,639

[22] Filed: Oct. 6, 1998

[51] Int. Cl.[7] ..... G21K 3/00

[52] U.S. Cl. ..... 378/158; 378/149; 378/156

[58] Field of Search ..... 378/145, 147, 378/148, 156, 158, 159, 152, 153, 155

[56] References Cited

U.S. PATENT DOCUMENTS

| | | | |
|---|---|---|---|
| 2,638,554 | 5/1953 | Bartow et al. | 250/99 |
| 2,825,817 | 3/1958 | North | 250/105 |
| 2,837,657 | 6/1958 | Craig et al. | 250/65 |
| 3,106,640 | 10/1963 | Oldendorf | 250/52 |
| 3,591,806 | 7/1971 | Brill et al. | 250/71.5 |
| 3,778,614 | 12/1973 | Hounsfield | 250/362 |
| 3,780,291 | 12/1973 | Stein et al. | 250/36.3 |
| 3,925,660 | 12/1975 | Albert | 250/272 |
| 3,936,639 | 2/1976 | Barrett | 250/369 |
| 3,944,833 | 3/1976 | Hounsfield | 250/367 |
| 3,949,229 | 4/1976 | Albert | 250/401 |
| 3,950,613 | 4/1976 | Macovski | 378/2 |
| 3,979,594 | 9/1976 | Anger | 250/369 |
| 3,983,397 | 9/1976 | Albert | 250/406 |
| 4,017,730 | 4/1977 | Barrett | 250/363 |
| 4,048,496 | 9/1977 | Albert | 250/272 |
| 4,057,745 | 11/1977 | Albert | 313/55 |
| 4,096,391 | 6/1978 | Barnes | 378/155 |
| 4,144,457 | 3/1979 | Albert | 250/445 |
| 4,196,351 | 4/1980 | Albert | 250/416 |
| 4,259,583 | 3/1981 | Albert | 250/416 |
| 4,260,885 | 4/1981 | Albert | 250/277 |
| 4,288,697 | 9/1981 | Albert | 250/505 |
| 4,321,473 | 3/1982 | Albert | 250/505 |
| 4,323,779 | 4/1982 | Albert | 250/401 |
| 4,393,127 | 7/1983 | Greschner et al. | 378/161 |
| 4,465,540 | 8/1984 | Albert | 156/252 |
| 4,519,092 | 5/1985 | Albert | 378/45 |
| 4,651,002 | 3/1987 | Anno | 378/155 |
| 4,688,242 | 8/1987 | Ema | 378/155 |
| 5,293,417 | 3/1994 | Wei et al. | 378/147 |
| 5,303,282 | 4/1994 | Kwasnick et al. | 378/147 |
| 5,550,378 | 8/1996 | Skillicorn et al. | 250/367 |
| 5,610,967 | 3/1997 | Moorman et al. | 378/154 |

FOREIGN PATENT DOCUMENTS

| | | | |
|---|---|---|---|
| WO 94/23458 | 10/1994 | WIPO | H01L 31/115 |
| WO 96/25024 | 8/1996 | WIPO | H05J 35/00 |

OTHER PUBLICATIONS

Gray, "Application of Optical Instrumentation in Medicine VII", Proceedings of the Society of Photo–Optical Instrumentation Engineers, Mar. 25–27, 1979, vol. 173, pp. 88–97.

Curry et al., *Christensen's Physics of Diagnostic Radiology*, Fourth Edition, Lea & Febiger, 1990, pp. 1–522.

*Primary Examiner*—David V. Bruce
*Assistant Examiner*—Drew A. Dunn
*Attorney, Agent, or Firm*—Lyon & Lyon LLP

[57] ABSTRACT

An x-ray beam hardening filter is disclosed. The x-ray beam hardening filter comprises a support member and a beam hardening sheet, the beam hardening sheet having a multidimensional array of regularly spaced apertures. The apertures are configured to have an x-ray transmissive quality. An actuator, engaging the support member, is capable of moving the multidimensional array of apertures into or out of a path of an x-ray beam, thereby selectively introducing varying levels of x-ray energy filtration. In one embodiment, multiple layers of beam hardening sheets are added to the x-ray beam hardening filter to create additional levels of x-ray energy filtration. Advantages of the x-ray beam hardening filter include the relatively small distance the x-ray beam hardening filter must move in order to absorb the incident x-ray beam, the ability to introduce varying levels of x-ray filtration, and the compact structure of the x-ray beam hardening filter.

25 Claims, 7 Drawing Sheets

BEAM HARDENING FILTER FOR X-RAY SOURCE

BACKGROUND OF THE INVENTION

1. Field of the Invention

This invention pertains to the field of diagnostic x-ray imaging, and more specifically to x-ray beam hardening filters.

2. Background

X-ray sources used in medical imaging are typically polychromatic, that is, the x-ray source produces x-ray photons with varying energies. For example, an x-ray source capable of producing a 120 keV photon will typically produce an x-ray beam having a mean energy of only one-third to one-half of the peak energy. Given that the mean energy is roughly one-half to one-third of the peak energy, many of the photons that comprise an x-ray beam will be characterized by energy levels below the mean energy.

A problem with lower energy photons is that they do not contribute to the construction of the radiographic image. Many of the lower energy photons, for example those with energies less than 20 keV, may be absorbed in the object under investigation; these lower energy photons only contribute to harmful patient radiation. Therefore, it is desirable to filter the lower energy x-ray photons from the x-ray beam.

It is known to use filters to remove lower energy photons from the x-ray beam. One form of filtration is inherent filtration. Inherent filtration results from the absorption of x-ray photons as they pass through the x-ray tube and its housing. Such filtration varies with the composition, or lining of the x-ray tube and housing, as well as the length of the x-ray tube and housing. Inherent filtration, which is measured in aluminum equivalents, typically varies between 0.5 and 1.0 mm aluminum equivalent.

A second form of filtration is added filtration. Added filtration is achieved by placing an x-ray attenuator or filter in the path of the x-ray beam. Most materials have the property of attenuating the lower energy photons more strongly than higher energy photons. When lower energy x-ray beams strike the added filter they are absorbed. By adding a filter to the x-ray beam path, lower energy x-ray photons can be absorbed, thereby reducing the unnecessary radiation created by the lower energy x-ray photons. Because the lower energy x-ray photons are preferentially removed from the x-ray beam, the mean energy of the x-ray beam is increased. Increasing the mean energy of the x-ray beam is referred to as "hardening" of the x-ray beam.

Objects to be x-rayed vary in thickness and composition. Thus, it is desirable to control the amount of filtration that occurs. Some x-ray systems, having a relatively small diameter x-ray source, often use a filter consisting of a thin sheet of aluminum or aluminum and copper. The filter is placed in the path of the x-ray beam, either manually or by an electromechanical actuator. Because of the small diameter of the x-ray source, the filter and filter control mechanism can be made compact.

However, when a large-area x-ray source (e.g., having a diameter of approximately 25 cm or larger) is used in an x-ray imaging system and if added filtration is used, the beam hardening filter inserted into the path of the x-ray beam would be as large as the overall x-ray source in order to cover the entire source. Furthermore, the mechanical travel of the filter to insert it into the path of the x-ray beam would also be about the same as the size of the x-ray source (e.g., 25 cm) or the filter. Using a conventional x-ray hardening filter, for example one that slides in a parallel plane to the surface of the x-ray source, on a large-area x-ray source would involve a large mechanical actuator assembly and would add undesirable bulk to the x-ray imaging system.

SUMMARY OF THE INVENTION

The present invention comprises an x-ray beam hardening filter for use with a scanning beam x-ray source wherein the movement of the filter between a position in the x-ray beams to a position outside the x-ray beams is less than either the size of the filter or the x-ray source area. According to one aspect of the invention, the x-ray beam hardening filter comprises a beam hardening sheet and an actuator. The beam hardening sheet has a first x-ray absorption quality and comprises a plurality of areas, the plurality of areas having a second x-ray absorption quality. The actuator is configured to move the beam hardening sheet into or out of the path of the x-ray beams such that the beam hardening sheet absorbs x-ray radiation according to the first or the second x-ray absorption quality.

According to another embodiment, a highly adjustable x-ray beam hardening filter is provided comprising more than one beam hardening sheet. Each beam hardening sheet has an array of areas, the array of areas having different x-ray absorption qualities. In such an embodiment, multiple levels of x-ray absorption and beam hardening are possible.

According to another embodiment, a method for hardening an x-ray beam is disclosed. The method comprises the acts of intercepting an x-ray beam with an x-ray beam hardening filter, the x-ray beam hardening filter having a first x-ray absorption quality and an array of areas having a second x-ray absorption quality, and moving the x-ray beam hardening filter a minimal distance.

BRIEF DESCRIPTION OF THE DRAWINGS

Preferred embodiments of the present invention are illustrated by way of example, and not by way of limitation, in the figures of the accompanying drawings and in which like reference numerals refer to similar elements and in which.

DETAILED DESCRIPTION OF THE PREFERRED EMBODIMENTS

This application is related to U.S. patent application Ser. Nos. 09/167,399, and 09/167,638, filed on the same day herewith, and U.S. Pat. No. 5,859,893, all of which are incorporated herein by reference in their entirety.

Figure 1:
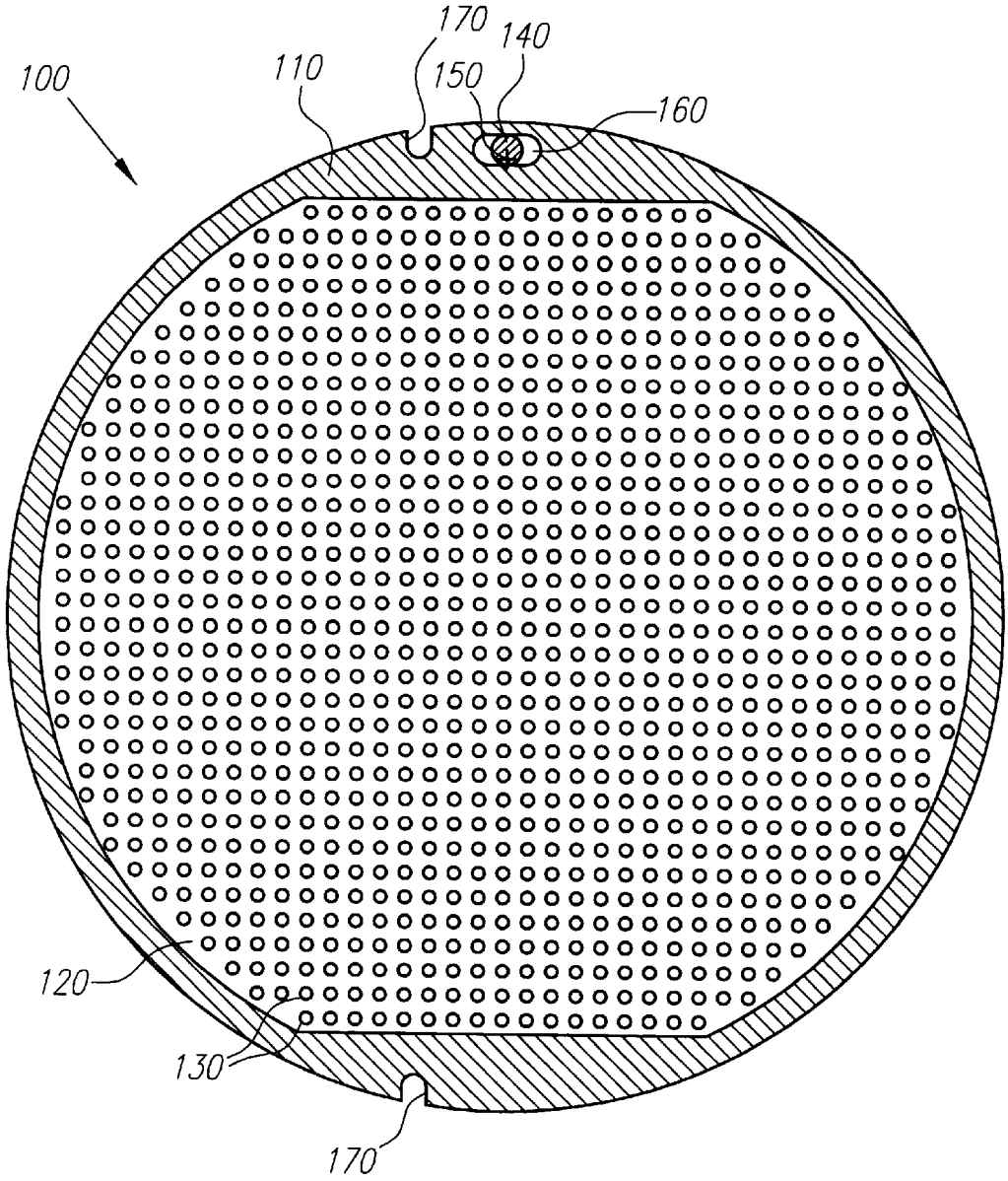
FIG. 1 depicts the x-ray beam hardening filter according to one embodiment of the present invention.

FIG. 1 depicts a top view of a x-ray beam hardening filter 100 according to an embodiment of the present invention. (As used herein, "top" and "bottom" are used only for purposes of illustration.) The x-ray beam hardening filter 100 preferably comprises a support member 110, a beam hardening sheet 120, and an actuator.

The support member 110 is preferably a stainless steel structure that has a washer-like shape. The support member 110 comprises one or more direction guides 170. According to one embodiment, two direction guides 170 are carved or etched into support member 110 at opposing sides. Preferably, the direction guides 170 facilitate alignment of the x-ray beam hardening filter 100 over a collimator, as well as directing the movement of x-ray beam hardening filter 100 in a straight path. However, according to an alternative embodiment, the direction guides 170 can be replaced by a single pin from which the x-ray support member 110 can pivot as it is moved at an opposing end.

The beam hardening sheet 120 is attached to the support member 110. The beam hardening sheet 120 is preferably composed of copper (Cu) and beryllium (Be). The copper is configured to absorb lower energy x-ray radiation, whereas the beryllium is added to increase the structural rigidity of the x-ray beam hardening filter 100. The actual ratio of the elements of the beam hardening sheet 120 can vary between x-ray imaging applications and objects to be imaged.

The beam hardening sheet 120 contains a plurality of coterminously arranged areas of varying x-ray absorption. The areas of varying x-ray absorption are disposed about an active area of the beam hardening sheet, that is, they are arranged in the areas where an x-ray beam is likely to be dwelled. Some of the plurality of coterminously arranged areas are configured to absorb a significant energy level from a polychromatic x-ray beam, such as 10 keV, whereas others are configured to absorb little to no x-ray energy from the polychromatic x-ray beam. These higher and lower levels of x-ray absorption are arranged in regular intervals about a surface area of the beam hardening sheet 120.

According to a preferred embodiment, an arrangement of varying levels of x-ray radiation is accomplished via a multidimensional array of apertures 130 which are disposed about the surface area of the beam hardening sheet 120. The array of apertures 130 are chemically etched into the surface of the beam hardening sheet 120 at regularly spaced intervals with a hole pitch of $A_p$. Each aperture 130 has a diameter $A_d$. Each aperture 130 is preferably no closer than to any other aperture than a distance approximately equal to diameter $A_d$. The apertures 130 are configured to allow x-ray photons to freely pass through them, whereas other areas of the beam hardening sheet 120 (that is, without apertures 130) are configured to absorb some of the x-ray photons incident thereon.

The beam hardening sheet 120 is bonded to the support member 110 with a brazing paste after aligning the apertures 130 within the support member 110, the movement of the actuator, and the collimator.

The support member 110 comprises a receiver. According to one embodiment, the receiver is a rectangular aperture 160. Within rectangular aperture 160, a cam 140, having a diameter $C_d$, is at least partially enclosed. The cam 140 rotates within rectangular aperture 160 based upon external control of a motor (not shown). The cam 140 is mounted to a cam shaft (not shown) at a rotation location 150. The rotation location 150 is offset from a center point of the rectangular aperture 160 a distance approximately equal to one-quarter of the aperture 130 pitch $A_p$. The rectangular aperture 160, it may be noted, has a major axis with a length of approximately twice the distance between the rotation location 150 and an outer most point on cam 140, and a minor axis approximately equal to the cam 140 diameter $C_d$.

As engagement mechanism is moved by the actuator (cam 140 is rotated by the motor), pressure is applied to the edge of the receiver (e.g., rectangular aperture 160). As pressure is applied, the support member 110 moves, in a path defined by direction guides 170, in a straight line. Since the beam hardening sheet 120 is attached to the support member, it also moves, thereby causing the apertures 130 to be placed either into or out of the path of x-ray beams which are passing through collimator apertures. (described in further detail with reference to FIG. 6.)

When the apertures 130 are aligned with collimator apertures, the x-ray beams pass through beam hardening filter 100 with little to no x-ray absorption. However, when the apertures are not in the path of the polychromatic x-ray beam, for example, when the areas between adjacent apertures 130 are aligned with the collimator apertures, then x-ray radiation is absorbed by the beam hardening sheet 120.

Figure 2A:
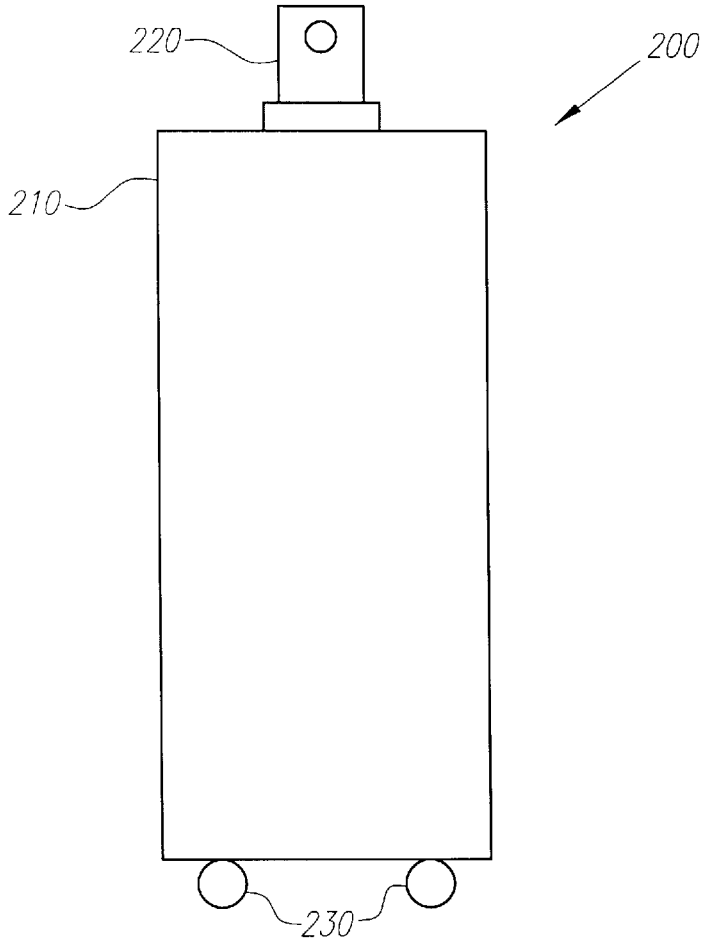
FIGS. 2A–B depict side and bottom views, respectively, of a motor used according to a preferred embodiment of the invention.
Figure 2B:
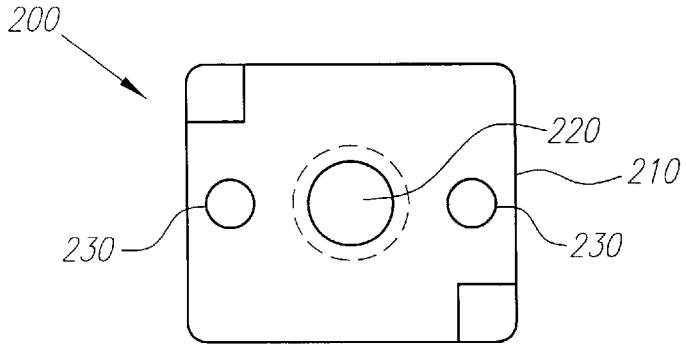

FIG. 2A depicts a side view of an electrical motor 200 employed as a part of the actuator. Preferably, the motor comprises a winding (not shown), housed in a motor block 210, the winding centered about a cam shaft 220. Terminals 230 receive two power cables. FIG. 2B depicts a bottom view of the motor 200, which also shows the terminals 230. According to one embodiment, the motor 200 has the following electrical and mechanical characteristics: 4.5 V, 170 mA, 205 mW, rated torque 500 g cm, 40 rpm, and a gear ratio of 1:298. A suitable motor meeting these characteristics is Copal Corporation model no. LA12G-344, which can be obtained through distributor PEI Sales Assoc. of Cupertino, Calif.

Figure 3A:
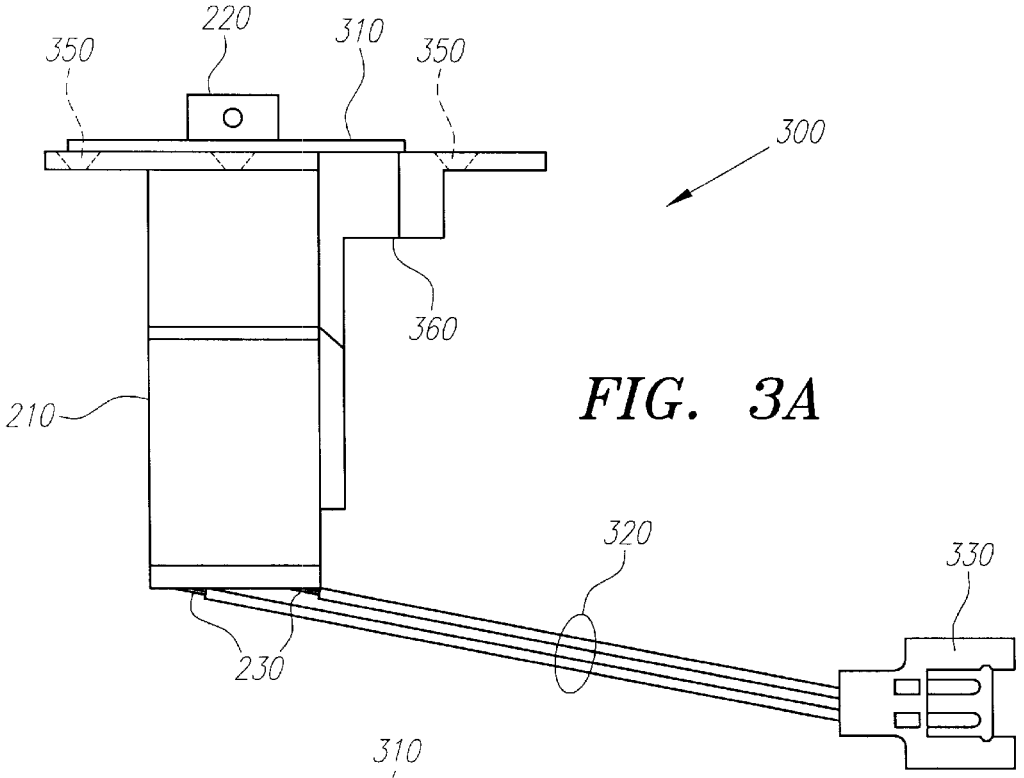
FIGS. 3A–C depict side and top views of the motor with a position sensor according to a preferred embodiment of the invention.
Figure 3B:
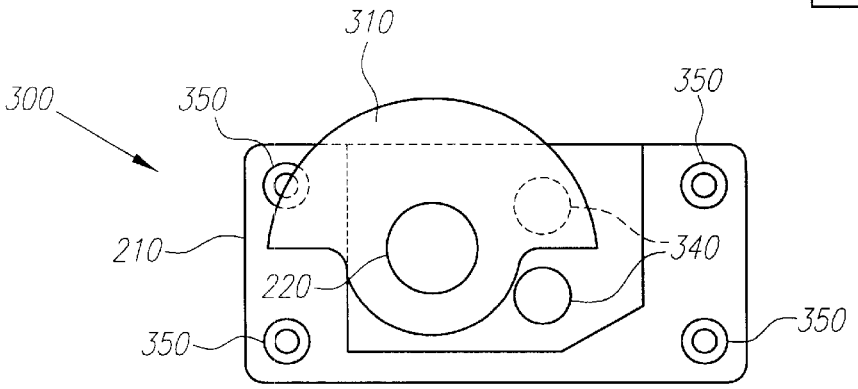
Figure 3C:
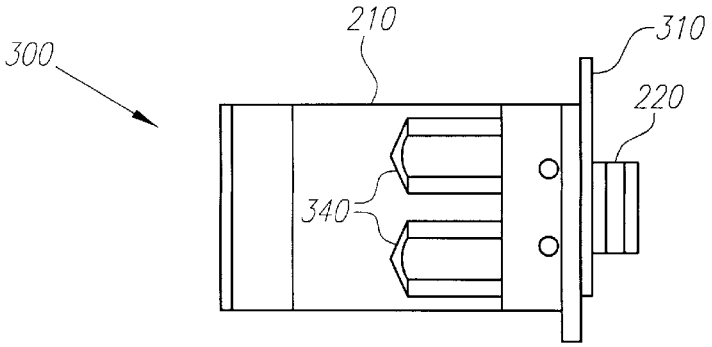

FIGS. 3A–C depict an actuator 300. Referring to FIG. 3A, mounting block 360 supports the motor housing 210 and is used to attach the motor housing 210 to the collimator. Furthermore, a position plate 310 rests at a base portion of cam shaft 220 (described in further detail with reference to FIGS. 4A–B). The position plate 310 will be described in further detail below and with reference to FIGS. 5A–C. Power cables 320 are shown attached to electrical terminals 230. Attached at an end of power cables 320 is a two prong male connector 330.

FIG. 3B depicts a top view of the actuator 300. Rivets 350 are used to connect the mounting block 360 to the collimator.

Also shown in FIG. 3B and 3C are position sensors 340. The sensors 340 are preferably electro-optical sensors. As the cam shaft 220 rotates, so too does the position plate 310.

According to a preferred embodiment, the position plate 310 is configured to alternatively cover the two sensors 340. Because of the shape of the sense plate and the rotation of the cam shaft 220, the approximate position of the apertures 130 relative to the collimator apertures can be known. For example, when a the position plate 310 covers only a first sensor, the x-ray beam hardening filter 100 is set in absorption mode, however, when only a second sensor is covered by the position plate 310, then the x-ray beam hardening filter 100 is set in a non-absorption mode (or a less absorbing mode). When both sensors 340 are simultaneously covered or uncovered, then the x-ray beam hardening filter 100 is in an intermediate phase between an absorbing and a non-absorbing mode.

Figure 4A:
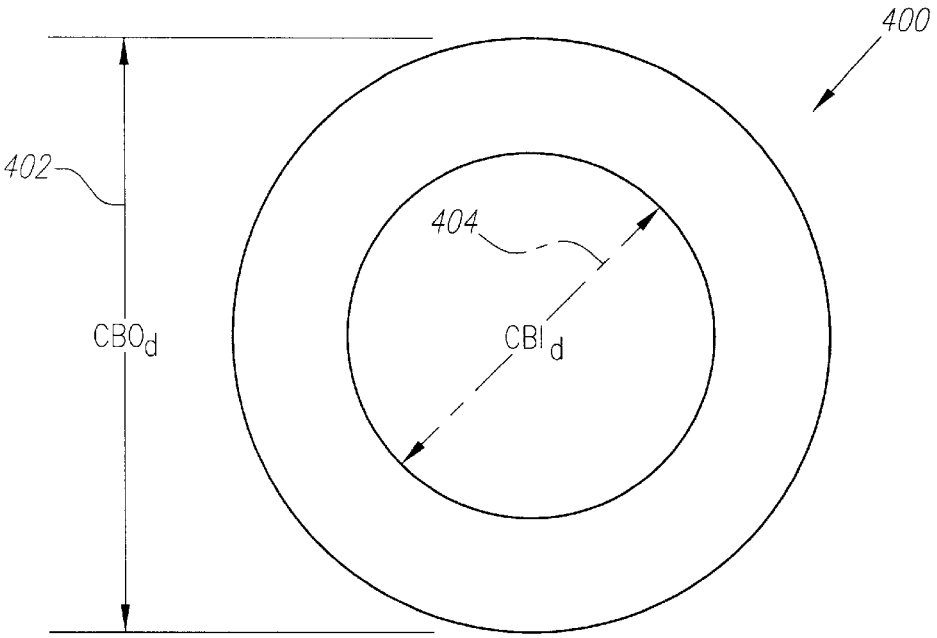
FIGS. 4A–B depict a top and a side view, respectively, of a cam bearing according to a preferred embodiment of the invention.

FIG. 4A depicts a top view of a cam bearing 400. The cam bearing 400 has an outer diameter ($CBO_d$) 402 and an inner diameter ($CBI_d$) 404. According to one embodiment, the outer diameter 402 is larger than the minor axis of the rectangular aperture 160, whereas the inner diameter 404 is smaller than the minor axis of the rectangular aperture 160.

Figure 4B:
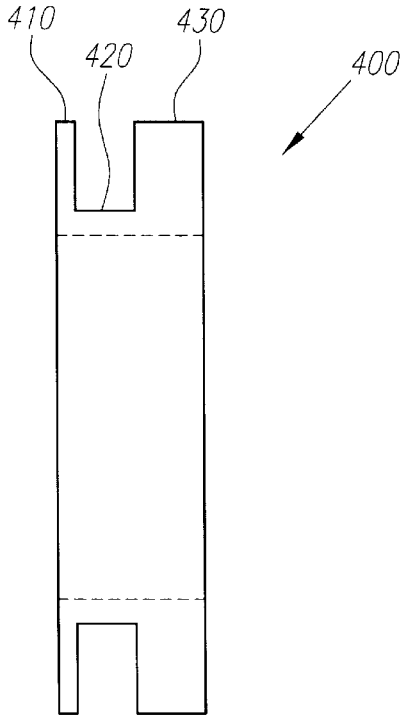

FIG. 4B depicts a side view of the cam bearing 400. Viewed from the side, cam bearing 400 essentially comprises three washer-shaped body parts 410, 420 and 430. Part 410 has is relatively thin (e.g., 0.010 inches), whereas parts 420 and 430 are relatively thick (e.g., 0.040 inches). Part 420 is configured to be at least thick enough such that support member 110 can slide between parts 410 and 430. In such an embodiment, the rectangular aperture 160 is modified to have not only the rectangular aperture 160 described above, but also a bulbous end extending from one side, the bulbous end creating an opening at least sufficiently large to pass the outer diameter ($CBO_d$) 402 through it. The rectangular aperture 160 has a minor axis approximately equal to the diameter of part 420, but smaller than the diameter ($CBO_d$) 402. Accordingly, the support member 110 is capable of dropping over the cam bearing 400 so that the bulbous end surrounds the cam bearing 400. The support member 110 is then slid from the bulbous end and toward the rectangular aperture 160 until it comes to rest within the cavity created by parts 410, 420 and 430. Alignment of the support member 110 is finalized with direction guides 170.

Figure 5A:
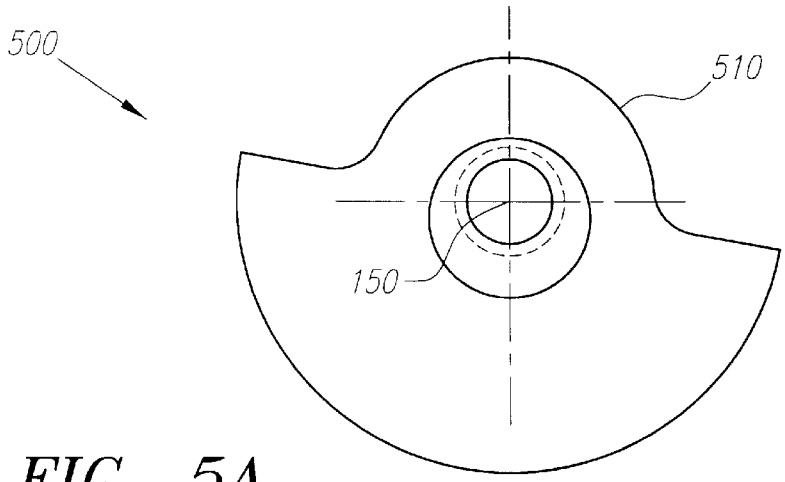
FIGS. 5A–C depict a bottom, top and side view, respectively, of a cam-filter control according to a preferred embodiment of the invention.
Figure 5B:
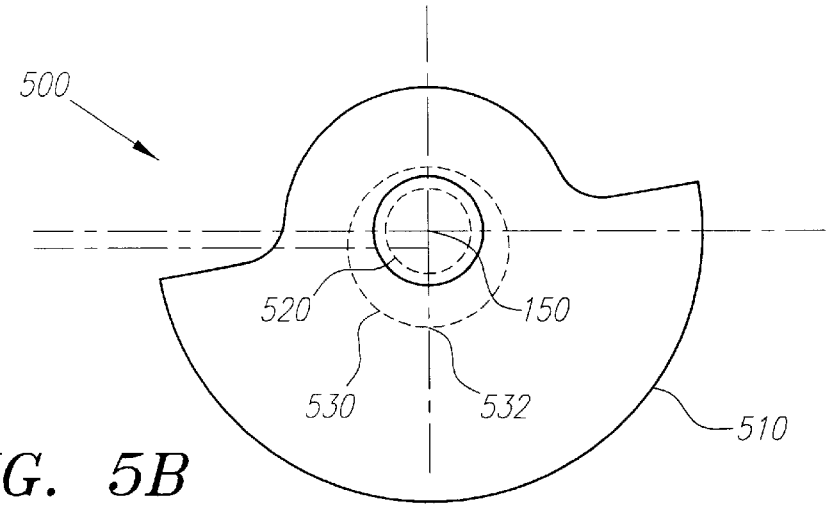
Figure 5C:
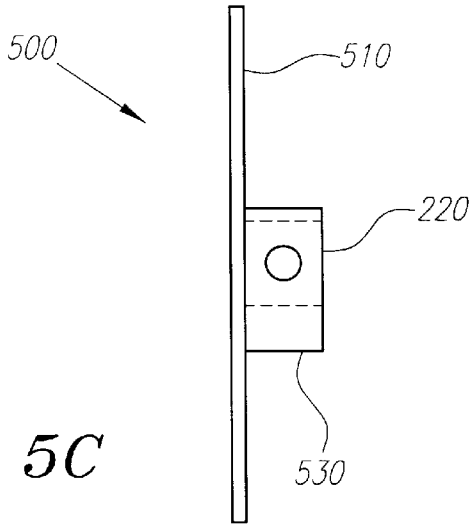

FIGS. 5A–C depict a cam-filter control 500. The cam-filter control 500 comprises a cam 530 and a position plate 510. An inner diameter 520 of the cam-filter control 500 is configured to slide over the cam shaft 220. Furthermore, the cam 530 and the position plate 510 are attached together such that the outermost point 532 (relative to rotation location 150) on the cam 530 is aligned to a point approximately 10° clockwise of the midpoint of the outer diameter of the position plate 510. The position plate 510 is substantially similar to the position plate 310, described above, the primary difference being it is secured to the cam 530 to form the cam-filter control 500.

As the cam shaft 220 rotates, the cam-filter control 500 does too. As the cam-filter control 500 rotates, the position plate 510 rotates over sensors 340. Additionally, the cam 530, through cam bearing 400, applies a force to the support member 110, which in turn moves the x-ray beam hardening filter 100 such that the apertures 130 are moved into or out of the path of the polychromatic x-ray beam.

Figure 6:
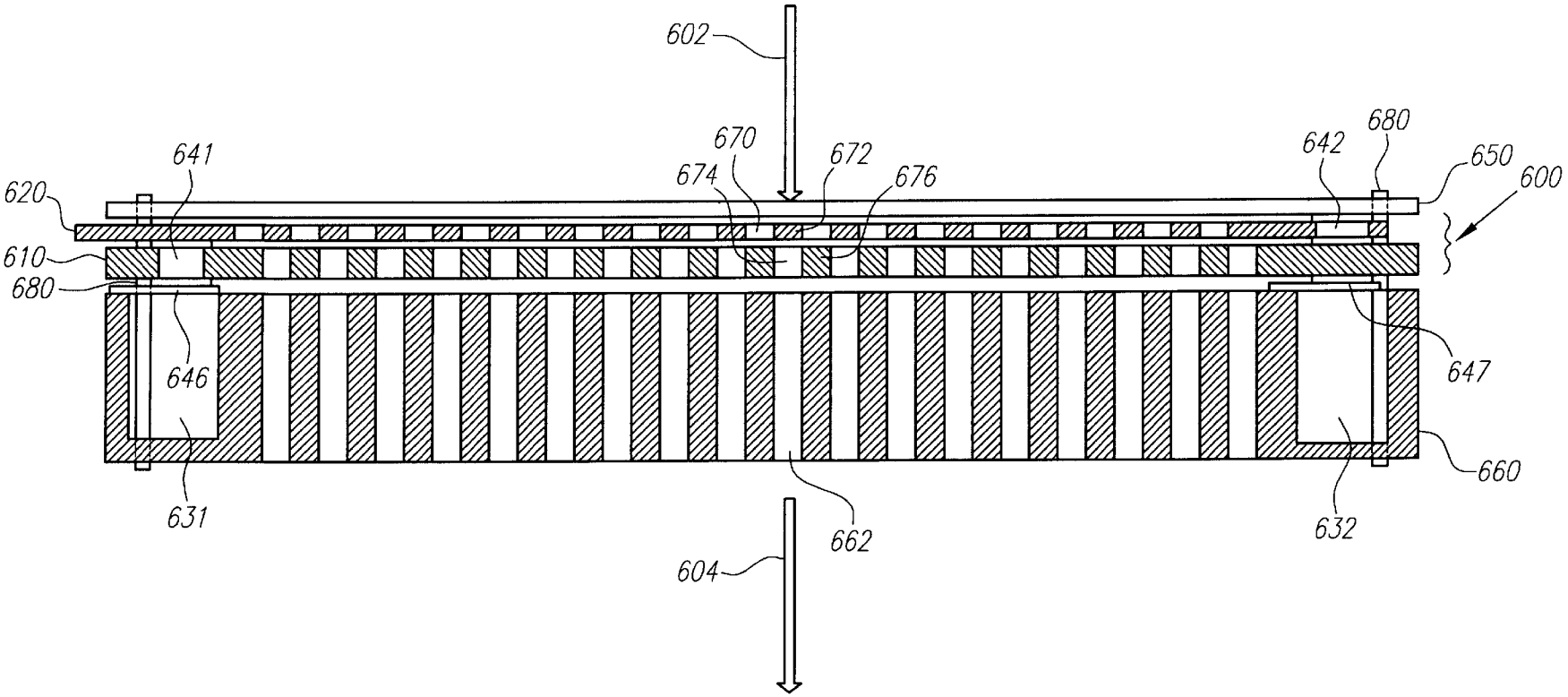
FIG. 6 depicts a cross-sectional view of a collimator and an x-ray beam hardening filter according to one embodiment of the invention.

FIG. 6 depicts a cross-sectional view of the x-ray beam hardening filter 600, together with a collimator 660 and a cover 650. The collimator 660 and the cover 650 are tied together with posts 680.

The cover 650 preferably comprises an x-ray transmissive material. The collimator 660 comprises of a material that is not x-ray transmissive. The collimator 660 further comprises an array of collimator apertures 662 through which x-rays (e.g., 604) can pass. Areas of the collimator through which incident x-rays can pass are said to be illumination areas, whereas areas where an incident x-ray beam cannot pass are called non-illumination areas. In the broader spirit of the invention, the collimator and x-ray beam hardening filter are part of an x-ray target assembly.

Mounted to collimator 660 are motors 631 and 632. The motors 631 and 632 are attached to the collimator 660 via mounting blocks (e.g., mounting blocks 360). The cam bearings 641 and 642 slip over the cam-filter controls 646 and 647, respectively, and lock into place (e.g., with locking pins or rings). In one embodiment, the cover 650 comprises a cooling element.

The x-ray beam hardening filter 600 comprises two independent beam hardening sheets 610 and 620. However, according to another embodiment, the x-ray beam hardening filter 600 comprises multiple filters substantially similar to the x-ray beam hardening filter 100 as depicted in FIG. 1. The cam bearing 641 engages first beam hardening sheet 610. The cam bearing 641 is rotated by the motor 631. The cam bearing 642 engages second beam hardening sheet 620. The cam bearing 642 is rotated by the motor 632. Together, the motor, the cam shaft, the cam-filter control, the cam and, the cam bearing form an actuator. However, in other embodiments, more or less parts can comprise the actuator, so long as the actuator is still configured to move a portion of the x-ray beam hardening filter 600.

If n beam hardening sheets are used in the x-ray beam hardening filter 600, then one or more actuators are preferably capable of moving the beam hardening sheets (e.g., 610 and 620) in $2^n$ different positions. For example, if four beam hardening sheets are employed, as many as four actuators can be used and $2^4$ (16) different positions of the four beam hardening sheets are possible. Different configurations of the actuators can accomplish such a positioning either by varying the cam shape or, simply by individually controlling each motor and cam.

Depending on the actuator configuration, as well as the collimator 660 configuration, notches and additional apertures may be cut into each successive layer of the x-ray beam hardening filter 600 so that movement of any layer is not physically constricted by another layer, or some other physical obstruction (e.g., a head of a rivet or bolt protruding through the top surface of collimator 660.)

Note that in FIG. 6, that beam hardening sheet 620 is slightly askew; that is, beam hardening sheet 620 is shifted to left in the figure relative to a fixed location, for example the collimator 660. When polychromatic x-ray beam 602 is incident upon beam hardening area 672, then a portion of the polychromatic x-ray beam 602 is absorbed by the beam hardening filter 620. The polychromatic x-ray beam passes through beam hardening sheet 620, then it passes through aperture 674 of beam hardening sheet 610, and finally it passes through the collimator aperture 662—as filtered polychromatic x-ray beam 604.

If beam hardening sheet 620 is shift right and beam hardening sheet 610 is shifted left, then polychromatic x-ray beam 602 is instead received at aperture 670. As the x-ray beam 602 passes through beam hardening sheet 620, it is received by beam hardening sheet 610, which is operating in absorption mode, at beam hardening area 676. Beam hardening area 676 absorbs a portion of the polychromatic x-ray beam 602 and the resulting beam is passed through collimator aperture 662 and exits collimator 660 as filtered polychromatic x-ray beam 604.

Based upon the mode of the beam hardening sheets 610 and 620 (e.g., absorbing or non-absorbing) the x-ray beam hardening filter 600 can absorb varying amounts of x-ray radiation from the incident x-ray beam 602.

Accordingly, the apertures 130 are configured to have a low x-ray transmissivity such that most, if not all of the x-ray photons incident on the aperture 130 pass through it.

According to a preferred embodiment, beam hardening sheet 610 absorbs twice the x-ray energy of beam hardening sheet 620. Doubling the absorption quality of each successive beam hardening sheet added to the filter, while employing actuators capable of $2^n$ positioning gives a high degree of control and selectivity of the x-ray beam hardening filter 600.

Alternatively, multiple beam hardening sheets employed in the x-ray beam filter can have the same x-ray absorption quality, which provides fewer distinct amounts of x-ray absorption of the overall x-ray beam hardening filter 600.

Figure 7:
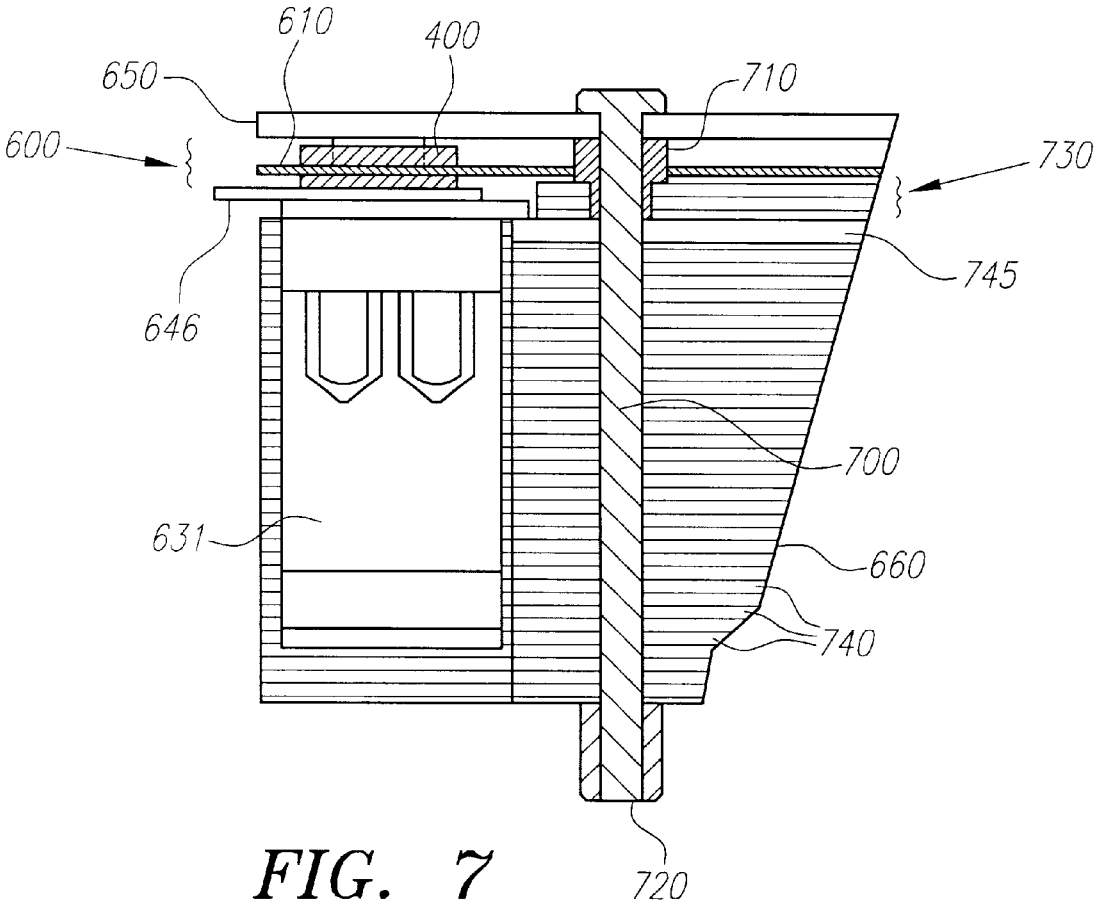
FIG. 7 depicts a cross-sectional view of a collimator and an x-ray beam hardening filter with a support pin according to a preferred embodiment of the invention.

FIG. 7 depicts a cross-sectional view of a collimator assembly incorporating an x-ray beam hardening filter 600. FIG. 7 depicts many of the same elements as FIG. 6, with like numerals referring to like elements. Added in FIG. 7 is detail pertaining to the collimator 660 and overall assembly of the x-ray beam hardening filter 600 with the collimator 660.

Collimator 660 comprises a plurality of collimator sheets 740 stacked one on top of the other. The collimator sheets 740 build up to a divider sheet 745, which provides structural support for the plurality of collimator sheets 740. On top of the divider sheet 745 are a plurality of trimmed collimator sheets 730, which simply create a void for the actuator components (e.g., motor 631 and cam-filter control 646).

A support pin 700 ties the collimator 660 and the collimator cover 650 together. The support pin 700 is located outside of the outer edge of the support member (e.g., support member 110) so that it will not obstruct movement of the beam hardening sheets. According to one embodiment, the outer edge of the support member comprises notches which prevent the beam hardening filter and the support pin 700 from colliding. In a preferred embodiment of the present invention, the collimator utilizes more than one support pin 700.

The support pin 700 further comprises a spacer 710, which allows pressure to be applied to the outer surfaces of the collimator assembly without increasing the friction on the beam hardening sheets (e.g., beam hardening sheets 610 and 620).

A unique feature of the present invention is that a minimum amount of movement is required to cause the x-ray beam hardening filter to intercept a polychromatic x-ray beam. In an x-ray system having a large area x-ray source (e.g., 25 cm), the x-ray beam hardening filters disclosed in the description and accompanying drawings is highly advantageous; it minimizes space compared to traditional beam hardening filters while providing a high degree of flexibility in the amount of x-ray radiation the beam hardening filter absorbs. The x-ray beam hardening filter does not need to be moved a distance as great as the diameter of the x-ray source to fully enable the x-ray beam hardening filter. Rather, the x-ray beam hardening filter can be moved a distance substantially less than the diameter of the x-ray source and accomplish the same end.

In the foregoing specification, the invention has been described with reference to specific embodiments thereof. It will be evident, however, that various modifications and changes may be made thereto without departing from the broader spirit and scope of the invention. The specification and drawings are, accordingly, to be regarded in an illustrative, rather than a restrictive sense.

What is claimed is:

1. A polychromatic x-ray source comprising:

an x-ray stepping beam source comprising a target assembly, said target assembly comprising electron beam illumination areas and non-illumination areas;

a beam hardening sheet, said beam hardening sheet formed of a material having a first x-ray absorption quality, said beam hardening sheet comprising a plurality of areas, said plurality of areas having a second x-ray absorption quality, and said beam hardening sheet having a first position and a second position;

an actuator, said actuator comprising an engagement mechanism, said engagement mechanism engaging said beam hardening sheet such that when said actuator is actuated, said engagement mechanism moves said beam hardening sheet between said first position and said second position; and when said beam hardening sheet is in said first position, said material having said first x-ray absorption quality is substantially aligned over said illumination areas and said plurality of areas having said second x-ray absorption quality are not in said illumination areas, and when said beam hardening sheet is in said second position, said plurality of areas having said second x-ray absorption quality are substantially aligned over said illumination areas.

2. The polychromatic x-ray source of claim 1, wherein said plurality of areas having said second x-ray absorption quality comprises a plurality of apertures.

3. The polychromatic x-ray source of claim 1, wherein said plurality of areas having said second x-ray absorption quality are evenly distributed about an active area of said beam hardening sheet, and wherein any two adjacent areas of said plurality of areas having said second x-ray absorption quality are separated by a distance not less than the distance across any single area of said plurality of areas having said second x-ray absorption quality.

4. The polychromatic x-ray source of claim 1, said beam hardening sheet further comprising a support member, said support member surrounding an active area, and wherein said engagement mechanism engages said support member.

5. The polychromatic x-ray source of claim 1, further comprising a position sensor, said sensor configured to output signals indicative of whether said beam hardening sheet is in said first position or said second position.

6. A polychromatic x-ray source comprising:

an x-ray stepping beam source comprising a target assembly, said target assembly comprising electron beam illumination areas and non-illumination areas;

a beam hardening sheet, said beam hardening sheet formed of a material having a first x-ray absorption quality, said beam hardening sheet comprising a plurality of areas, said plurality of areas having a second x-ray absorption quality, and said beam hardening sheet having a first position and a second position;

an actuator, said actuator comprising an engagement mechanism, said engagement mechanism engaging said beam hardening sheet such that when said actuator is actuated, said engagement mechanism moves said beam hardening sheet between said first position and said second position, when said beam hardening sheet is in said first position, said plurality of areas having said first x-ray absorption quality are substantially aligned over said illumination areas, and when said beam hardening sheet is in said second position, said plurality of areas having said second x-ray absorption quality are substantially aligned over said illumination areas; and at least one more beam hardening sheet, said at least one more beam hardening sheet arranged in the x-ray beam path, and said at least one more beam hardening sheet formed of a material having a third x-ray absorption quality, said at least one more beam hardening sheet comprising a plurality of areas, said plurality of areas of said one more beam hardening sheet having a fourth x-ray absorption quality.

7. The polychromatic x-ray source of claim 6, said at least one more beam hardening sheet adjacent to said beam hardening sheet.

8. The polychromatic x-ray source of claim 7, wherein when said beam hardening sheet is in said first position, said at least one more beam hardening sheet may be either in said first or said second position, and wherein when said beam hardening sheet is in said second position, said at least one more beam hardening sheet may be either in said first or said second position.

9. The polychromatic x-ray source of claim 6, wherein said plurality of areas having said second x-ray absorption quality comprises a plurality of apertures.

10. The polychromatic x-ray source of claim 6, wherein said plurality of areas having said second x-ray absorption quality are evenly distributed about an active area of said beam hardening sheet, and wherein any two adjacent areas of said plurality of areas having said second x-ray absorption quality are separated by a distance not less than the distance across any single area of said plurality of areas having said second x-ray absorption quality.

11. The polychromatic x-ray source of claim 6, said beam hardening sheet further comprising a support member, said support member surrounding an active area, and wherein said engagement mechanism engages said support member.

12. The polychromatic x-ray source of claim 6, further comprising a position sensor, said sensor configured to output signals indicative of whether said beam hardening sheet is in said first position or said second position.

13. An x-ray beam hardening filter assembly comprising:

a collimator, said collimator comprising a plurality of x-ray transmissive areas, said x-ray transmissive areas disposed about said collimator in a first arrangement;

a beam hardening sheet, said beam hardening sheet having a plurality of areas disposed over an active area of said beam hardening sheet, said plurality of areas disposed over said active area in a second arrangement; and an actuator, said actuator comprising an engagement mechanism, said engagement mechanism configured to move said beam hardening sheet between a first position and a second position, wherein when said beam hardening sheet is in said first position, said plurality of x-ray transmissive areas of said collimator and said plurality of areas of said beam hardening sheet are substantially aligned and when said beam hardening sheet is in said second position, said plurality of x-ray transmissive areas of said collimator and said plurality of areas of said beam hardening sheet are not substantially aligned.

14. The x-ray beam hardening filter assembly of claim 13:

said beam hardening sheet comprising a receiver, said receiving at a substantially rectangular shape;

said engagement mechanism comprising:

a cam shaft; and a cam bearing attached to said cam shaft at a rotation location, said rotation location offset from a center point of said cam bearing by a distance approximately equal to one-quarter a dimension between two adjacent areas of said plurality of areas; and a motor, said actuator comprising said cam shaft rotatably attached to said motor.

15. The x-ray beam hardening filter assembly of claim 13, wherein said plurality of areas comprises a multidimensional array of apertures, said multidimensional array of apertures evenly distributed about said active area of said beam hardening sheet.

16. An x-ray beam hardening filter assembly comprising:

a collimator, said collimator comprising a plurality of x-ray transmissive areas, said x-ray transmissive areas disposed about said collimator in a first arrangement;

a beam hardening sheet, said beam hardening sheet having a plurality of areas disposed over an active area of said beam hardening sheet, said plurality of areas disposed over said active area in a second arrangement;

an actuator, said actuator comprising an engagement mechanism, said engagement mechanism configured to move said beam hardening sheet between a first position and a second position, wherein said plurality of areas are arranged with said plurality of x-ray transmissive areas; and at least one more beam hardening sheet, said at least one more beam hardening sheet substantially parallel to said beam hardening sheet, said at least one more beam hardening sheet having a plurality of areas disposed over an active area of said at least one more beam hardening sheet, said plurality of areas of said at least one more beam hardening sheet disposed over said active area of said at least one more beam hardening sheet in a third arrangement, said first arrangement and said third arrangement substantially similar.

17. The x-ray beam hardening filter assembly of claim 16:

said beam hardening sheet comprising a receiver, said receiving at a substantially rectangular shape;

said engagement mechanism comprising:

a cam shaft; and a cam bearing attached to said cam shaft at a rotation location, said rotation location offset from a center point of said cam bearing by a distance approximately equal to one-quarter a dimension between two adjacent areas of said plurality of areas; and a motor, said actuator comprising said cam shaft rotatably attached to said motor.

18. The x-ray beam hardening filter assembly of claim 16, wherein said plurality of areas comprises a multidimensional array of apertures, said multidimensional array of apertures evenly distributed about said active area of said beam hardening sheet.

19. The x-ray beam hardening filter assembly of claim 16, said first arrangement and said second arrangement are substantially aligned.

20. An x-ray beam hardening filter comprising:

a beam hardening sheet, said beam hardening sheet having a first x-ray absorption quality, said beam hardening sheet comprising an array of areas having a second x-ray absorption quality; and an actuator engaging said beam hardening sheet, said actuator configured to move said beam hardening sheet such that an x-ray beam is absorbed according to said first x-ray absorption quality and said x-ray beam is not absorbed according to said second x-ray absorption quality of said beam hardening sheet, or such that an x-ray beam is absorbed according to said second x-ray absorption quality of said beam hardening sheet.

21. The x-ray beam hardening filter of claim 20, said beam hardening sheet comprising two or more of said array areas having said second x-ray absorption quality, said two or more array of said areas forming a multidimensional array of areas having said second x-ray absorption quality.

22. The x-ray beam hardening filter of claim 20, wherein movement of said array of areas relative to a fixed location is not greater than a distance of approximately three times a greatest spacing between two adjacent areas of array of areas.

23. A method for hardening an x-ray beam comprising:

intercepting the x-ray beam with an x-ray beam hardening filter, said x-ray beam hardening filter having a first x-ray absorption quality and an array of areas having a second x-ray absorption quality; and moving said x-ray beam hardening filter along a path no greater than three times a greatest distance between two adjacent areas in said array of areas (1) such that the x-ray beam does not pass through said array of areas having a second absorption quality whereby said x-ray beam hardening filter exhibits the first x-ray absorption quality or (2) such that the x-ray beam passes through said array of areas having a second absorption quality whereby said x-ray beam hardening filter exhibits the second x-ray absorption quality.

24. The method of claim 23, the x-ray beam hardening filter further comprising a plurality of beam hardening sheets, said method further comprising:

selectively interposing two or more of said plurality of beam hardening sheets into said x-ray beam; and varying, an x-ray absorption quality of said x-ray beam hardening filter by said act of selectively interposing said two or more of said plurality of beam hardening sheets.

25. The method of claim 23, further comprising:

sensing a position of said x-ray beam hardening filter;

returning a signal indicative of the position of said x-ray beam hardening filter; and in response to said act of returning said signal indicative of the position, modifying the position of said x-ray beam hardening filter.

* * * * *